US012036482B1

(12) United States Patent
Seaver

(10) Patent No.: US 12,036,482 B1
(45) Date of Patent: Jul. 16, 2024

(54) TOY SUPPORT DEVICE

(71) Applicant: Amy Seaver, Concord, CA (US)

(72) Inventor: Amy Seaver, Concord, CA (US)

( * ) Notice: Subject to any disclaimer, the term of this patent is extended or adjusted under 35 U.S.C. 154(b) by 168 days.

(21) Appl. No.: 17/946,800

(22) Filed: Sep. 16, 2022

(51) Int. Cl.

| | |
|---|---|
| ***A63H 33/00*** | (2006.01) |
| ***A44B 13/00*** | (2006.01) |
| ***A63H 3/14*** | (2006.01) |
| *A45F 5/00* | (2006.01) |
| *A63H 3/00* | (2006.01) |
| *A63H 3/02* | (2006.01) |

(52) U.S. Cl.
CPC ..... *A63H 33/00* (2013.01); *A44B 13/00* (2013.01); *A63H 3/14* (2013.01); *A45F 2005/008* (2013.01); *A63H 3/003* (2013.01); *A63H 3/02* (2013.01)

(58) Field of Classification Search
CPC ..... A45F 2005/008; A63H 3/14; A63H 33/00
See application file for complete search history.

(56) References Cited

U.S. PATENT DOCUMENTS 4,685,599 A * 8/1987 Israel ..... G04B 37/1433 968/351
5,993,285 A * 11/1999 Sofia ..... A63H 3/14 446/26
6,223,958 B1 * 5/2001 Kohn ..... A45C 1/04 224/267
8,062,087 B1 * 11/2011 Davis ..... A63H 3/14 446/26
10,448,728 B1 * 10/2019 Gregory ..... A45F 3/14
2006/0183397 A1 * 8/2006 Kanahele ..... A63H 33/006 446/26
2006/0261107 A1 * 11/2006 Daniels ..... A45C 1/04 224/221
2008/0223892 A1 * 9/2008 Hamilton ..... A45F 5/00 224/267
2011/0290835 A1 * 12/2011 Bartet ..... A45F 5/00 224/267
2012/0329357 A1 * 12/2012 Brodess ..... A41D 20/00 446/26
2013/0287971 A1 * 10/2013 Caldwell ..... A47G 33/00 428/12
2014/0110444 A1 * 4/2014 Austin ..... A45F 5/00 224/219
2023/0218048 A1 * 7/2023 Newman ..... A44C 5/0007 63/3.1

* cited by examiner

*Primary Examiner* — John A Ricci
(74) *Attorney, Agent, or Firm* — Theodore J. Bielen, Jr.

(57) ABSTRACT

A device for removably supporting a toy to the limb of a user utilizing a flexible sheet of fabric which is able to wrap around the limb of a user. The flexible sheet includes surfaces which bear connecting material that permit the removable attachment of a toy for display.

10 Claims, 3 Drawing Sheets

TOY SUPPORT DEVICE

BACKGROUND OF THE INVENTION

The present application concerns a transportable and showable toy.

Toys or playthings are objects that are normally used to provide entertainment. Generally, toys, such as blocks, games, dolls, and the like, are designed for use by children. It is said that playing with toys by children is a way of training young children for life experiences. In many cases, children carry or transport favorite toys in close proximity and at all times.

In the past, ideas have been proposed for attachment of items to the arms of a person. For example, United States Design Patent D594463 shows a wrist rest that is connected to a person by hook and pile fasteners.

United States Patent Publication US2011/0290835 describes an infant grip that utilizes a wrap extending around the wrist of a child with a tether connected to the same for holding a baby implement, such as a toy.

United States Patent Publication 2013/0287971 teaches a toy in the form of a wing creature that is attached to a band wrapped about the wrist of the user. A panel across the band holds the wing structure in place.

United States Patent 4,685, 599 illustrates a child's wrist watch construction having a strap that is detachably secured to the wrist of the wearer. An enlarged three dimensional ornament is attached to the strap element and may be in the form of a plush toy that hinges between an open and closed position. A time piece is attached to the strap element and is visible when the plush toy is hinged outwardly from the strap.

A toy support for displaying and removably holding a toy to a limb of a child or person would be a notable advance in the field of toys and playthings.

SUMMARY OF THE INVENTION

In accordance with the present application, a novel and useful device intended for removably supporting a toy to the limb of a user is hereinafter provided.

The device includes a flexible sheet of fabric having a first surface and an opposite second surface. The first surface possesses a first section that has a first mating material, an adjacent second section having a second mating material, and a flap rotatably attached to the flexible sheet of material. The flap is capable of overlying the first surface of the flexible sheet upon rotation and further includes a section of the first mating material. The second mating material of the second section of the first surface of the flexible sheet being removably connected to the first mating material of the flap. Thus, the flap may be held against the second section of the first surface of the flexible sheet.

The second opposite surface of the flexible sheet of material possesses a section of the second mating material. The first mating material of the first section of the first surface is removably connectable to the second mating material of the opposite second surface of the flexible sheet of material to form a wrap encompassing the limb of the user. Also, such connecting of the second mating material of the opposite second surface of the flexible sheet to the first section of the first surface of the flexible sheet of material forms a chamber. The flap may be hingedly rotated relative to the flexible sheet to occupy the chamber.

A toy is also employed in the present device and includes a section of the first mating material for removably connecting the toy to the second mating material of the second section of the first surface of the flexible sheet of fabric. Thus, the toy may be displayed on the limb of the user or removed for storage. When removed, as heretofore described, the flap may be rotated into position and held over the second mating material of the second section of the first surface of the flexible sheet. Such positioning of the flap prevents extraneous material adhering to the second mating material of the second surface of the flexible sheet while the wrap encompasses the limb of the user.

The sheet of flexible material may further include a pocket and a patch which is sized to fit within the pocket. The patch may be employed to cover the section of first mating material on the toy for preservation and protection of the same.

It may be apparent that a novel and useful device intended for removably supporting a toy to the limb of a user has been hereinabove described.

It is therefore an object of the present application to provide a device intended for removably supporting a toy to a limb of a user that is simple to use and manufacture.

Another object of the present application is to provide a device intended for removably supporting a toy to a limb of a user that allows a user to display toys of various types and designs.

Another object of the present application is to provide a device intended for removably supporting a toy to a limb of a user that is maneuverable by children of young ages.

Another object of the present application is to provide a device intended for removably supporting a toy to a limb of a user that includes a wrap that is adjustable in circumference when attached to the limb of a user.

Another object of the present application is to provide a device intended for removably supporting a toy to a limb of a user that is capable of displaying toys in various positions of orientation.

The application possesses other objects and advantages especially as concerns particular characteristics and features thereof which will become apparent as the specification continues.

For a better understanding of the application, reference is made to the following detailed description of the preferred embodiments thereof which should be taken in conjunction with the prior described drawings.

DETAILED DESCRIPTION OF THE PREFERRED EMBODIMENTS

Various aspects of the present application will evolve from the following detailed description of the preferred embodiments thereof, which should be referenced to the prior delineated drawings.

Figure 5:
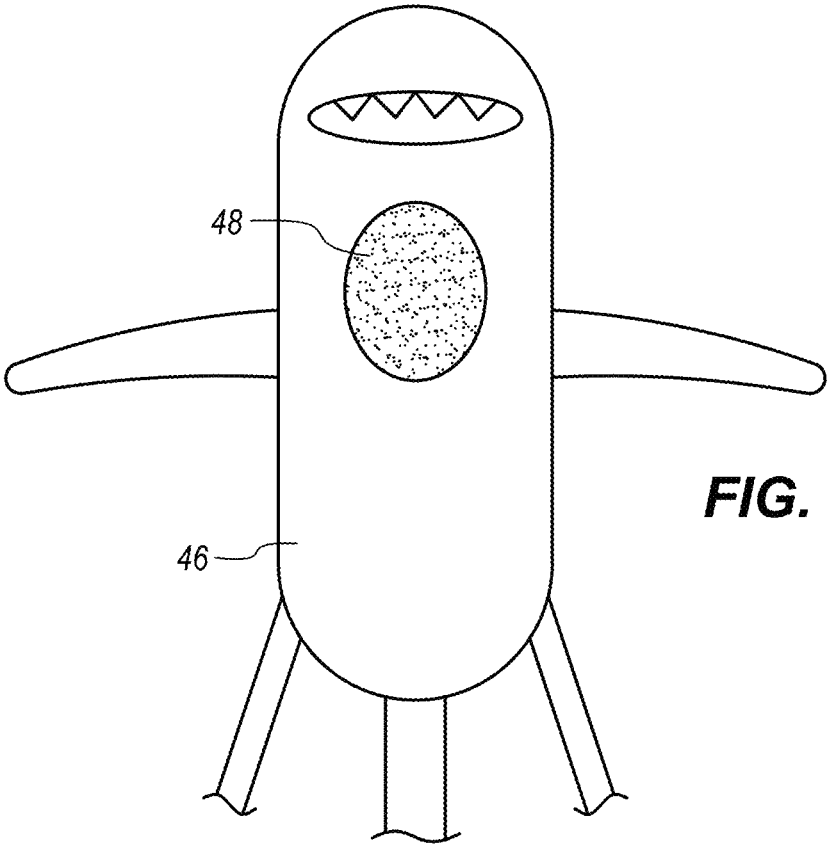
FIG. 5 is a front elevational view of a plush toy usable with the flexible sheet of fabric displayed in FIGS. 1-4.

The device as a whole is shown in the drawings by reference character 10, best viewed in FIG. 5. Device 10 includes as one of its elements a flexible sheet of material 12 which may comprise common cloth or like fabric. Elements of device 10 may include the use of first and second mating materials that are connectable to each other. A commercial product known as Velcro may be employed as the first and second mating materials in the form of hook and/or pile elements connectable to one another. It should be understood that the first and second mating materials may be interchangeable in the device 10 of the present application. That is to say, hook material may be substituted for pile material and vice versa throughout, as long as mating pairs result.

Figure 1:
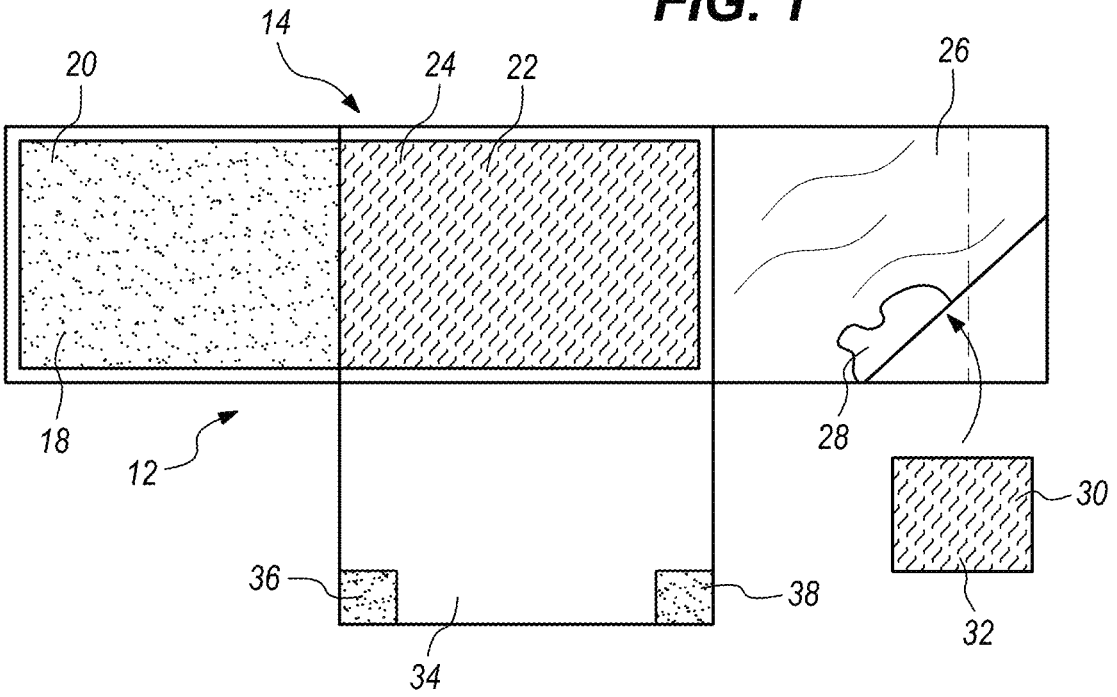
FIG. 1 is a first front plan view of the flexible sheet of material employed in the present application.
Figure 2:
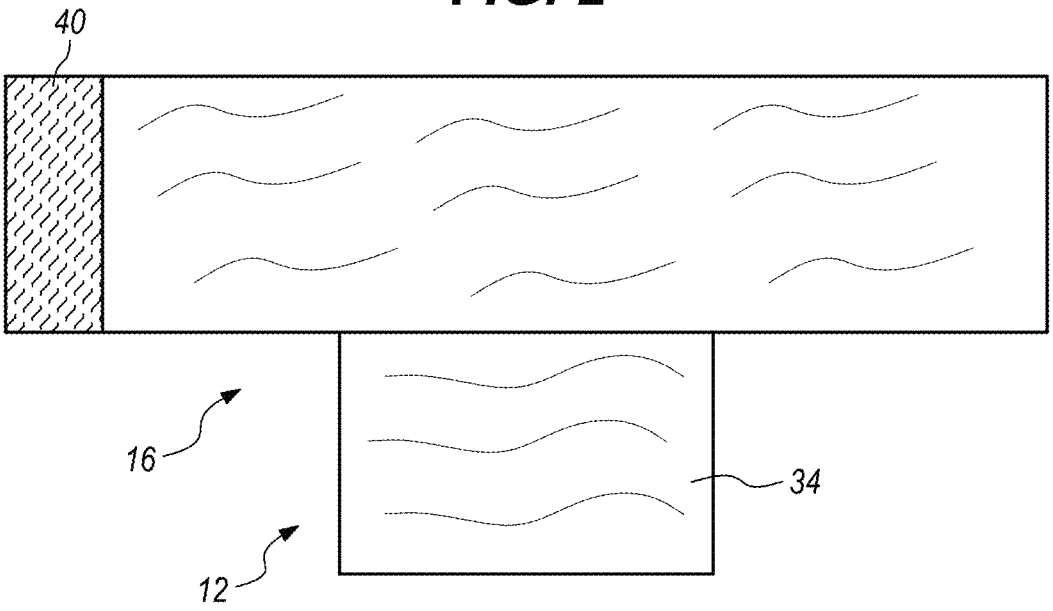
FIG. 2 is a back plan view of the flexible sheet of material displayed in FIG. 1.

Flexible sheet of material 12 is illustrated as having a first surface 14, FIG. 1 and a second opposite surface 16, FIG. 2. Again looking at FIG. 1, first surface 14 is formed with a first section 18 having a first mating material 20. Further, first surface 14 includes a second section 22 having a second mating material 24. As stated, it should be understood that first mating material 20 and second mating material 24 connect to one another when in contact. In addition, sheet of flexible material 12 includes a third section 26 which forms a pocket 28 that is capable of holding a patch 30 possessing second mating material 32, the purpose of which will be discussed as the specification continues. First and second mating materials may take the form of strips attached to the sheet of flexible material 12.

Also, a flap 34 is rotatably attached to sheet of flexible material 12. Flap 34 possesses swatches 36 and 38 of first mating material 38. As will be discussed hereinafter, flap 34 may be rotated toward second section 22 to allow the engagement of the first mating material of swatches 36 and 38 with the second mating material 24 of second section 22.

Turning to FIG. 2, it may be observed that second surface 16 of sheet of flexible material 12 is formed with a section 40 of second mating material.

Figure 3:
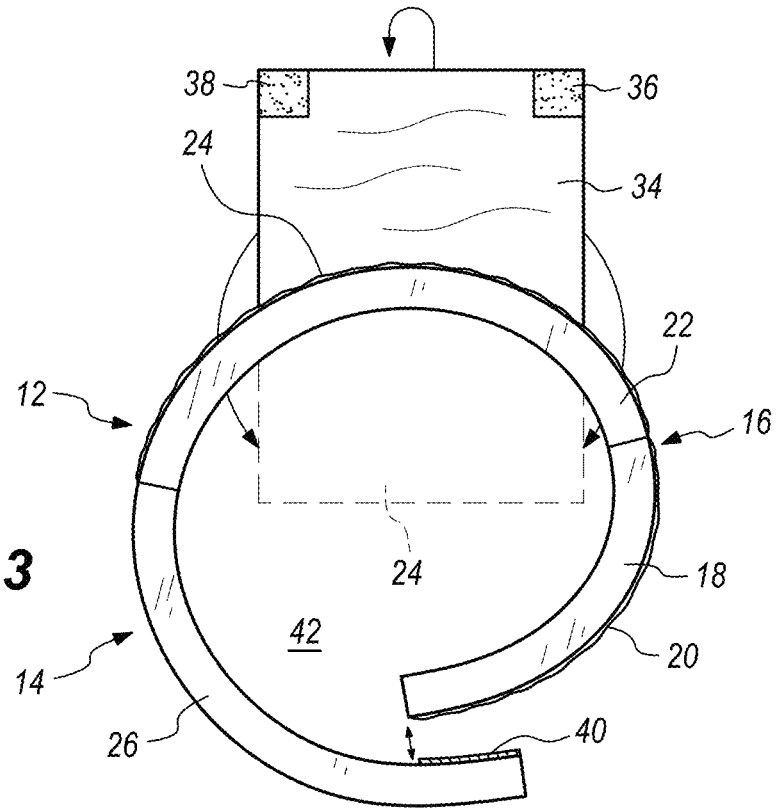
FIG. 3 is a top plan view of the flexible sheet of material illustrating the rotatable flap portion movable in two alternate directions.
Figure 4:
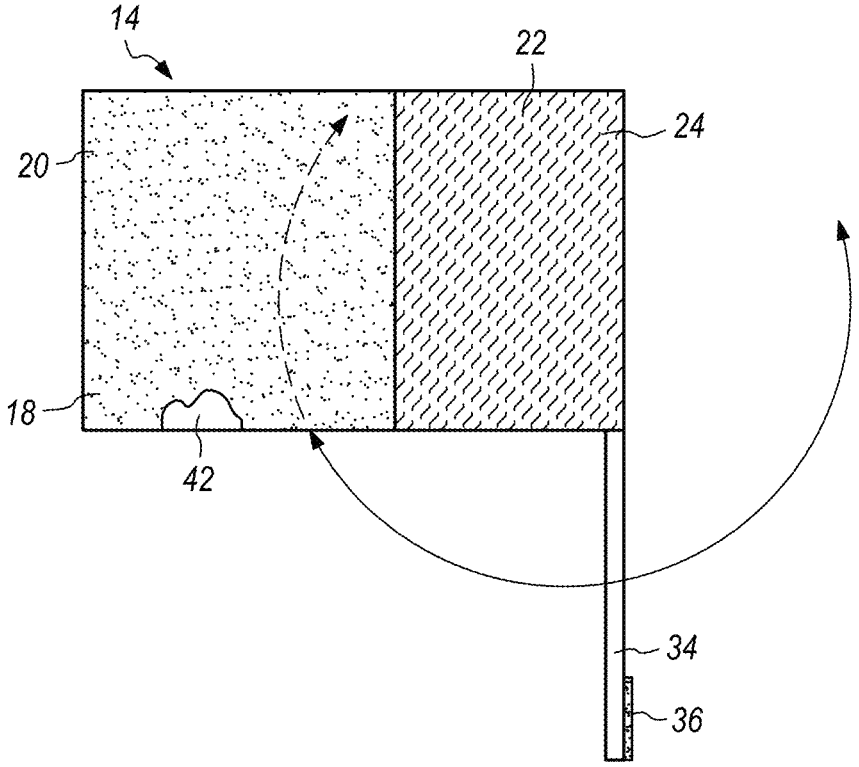
FIG. 4 is a right side elevational view of the device depicted in FIG. 3 illustrating the rotatability of the flap portion.
Figure 6:
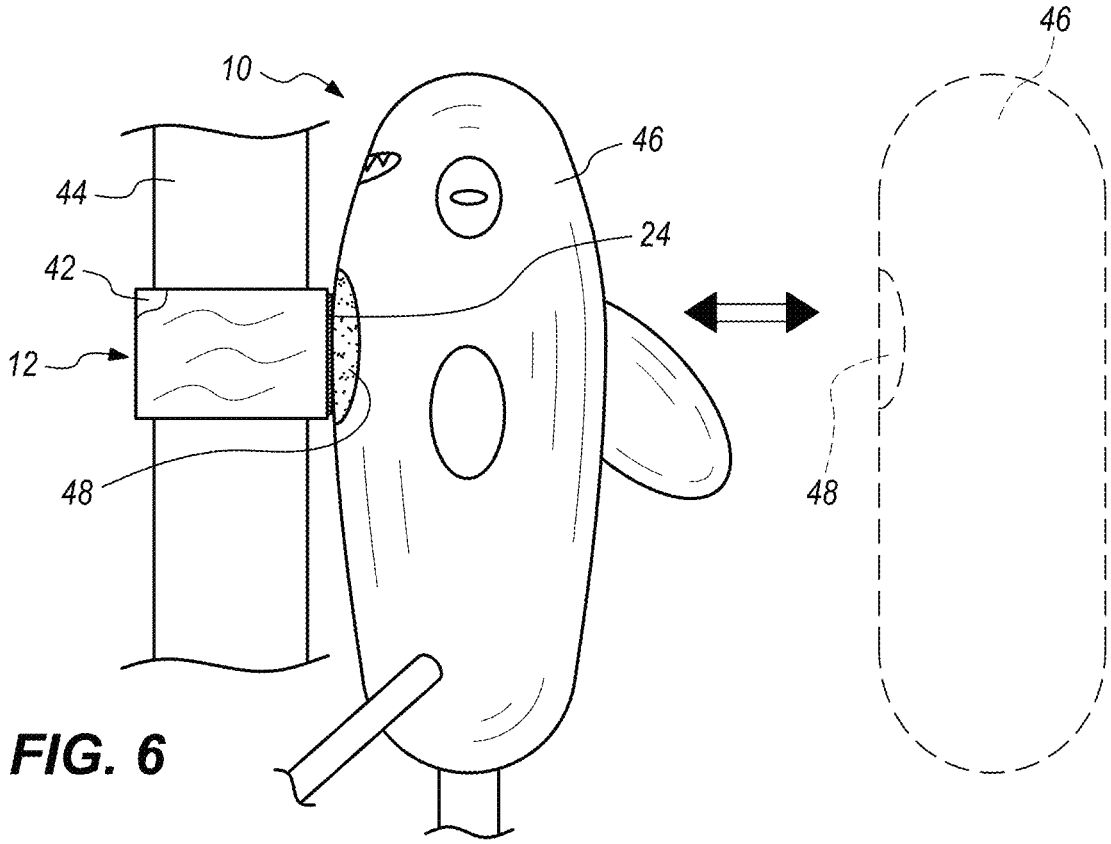
FIG. 6 is a side elevational view of the toy of FIG. 5 attached to the flexible sheet of material when wrapped around a limb of a user and showing the removability of the same.

Viewing now FIG. 3, it may be seen that sheet of flexible material 12 is bent such that first mating material 20 of first section 18 is removably connectable to section 40 of second mating material to form a chamber 42. Chamber 42 is intended to enclose the limb 44 of the user (FIG. 6). Also, flap 34 is configured to hingedly rotate relative to flexible sheet 12 and to occupy chamber 42 when limb 44 lies within chamber 42.

Toy 46, FIG. 5, forms part of device 10 of the present application. Toy 46, in the form of a plush rendition of a shark, includes a section 48 of first mating material. FIG. 6 illustrates the interconnection of toy 46 to sheet of flexible material 12 when sheet 12 is wrapped about limb 44 of the user. Needless to say, limb 44 may be an arm, leg, or the like. Specifically, section 48 of second mating material connects to section 24 of second mating material found on the first surface 14 of sheet of flexible material 12. As heretofore mentioned, flap 34 may be tucked into chamber 42 formed by the wrapping of sheet of flexible material 12 about limb 44. As illustrated, toy 46 (shown in phantom) is completely removable from sheet of flexible material 12 by the separation between the first mating material of section 48 of toy 46 and the second mating material 24 of second section 22 of sheet of flexible material 12. When toy 46 is connected to sheet of flexible material 12, FIG. 6, patch 30 may be placed within pocket 28 of third section 26 of sheet of flexible material 12. Once toy 46 has been separated from sheet of flexible material 12 (illustrated in FIG. 6), patch 30 may be placed over section 48 of first mating material to protect the same from dust, lint, and other undesirable stray materials.

In operation, the user folds sheet of flexible material 12 about limb 44 of the user, FIG. 6. A chamber 42 is formed in this step by the connecting of first mating material 20 of first section 18 and the second mating material of section 40, FIG. 3. Toy 46 may then be fastened to sheet of flexible material 12 by the interaction between section 48 of first mating material of toy 46 and the second mating material 24 of the second section 22 of sheet of flexible material 12. The toy may be oriented in various configurations relative to limb 40 for display, as desired by the user. Once the user has finished displaying toy 46, toy 46 may be removed, as shown in FIG. 6. Patch 30 may then be taken from pocket 28 of sheet of flexible material 12 and covered over section 48 of toy 46 to protect the same. Also, flap 34 may be rotated upwardly and held to section 22 to cover and protect second mating material 24 of second section 22 of flexible sheet 12.

While in the foregoing embodiments of the application have been set forth in considerable detail for the purposes of making a complete disclosure of the invention, it may be apparent to those of skill in the art that numerous changes may be made in such details without departing from the spirit and principles of the application.

The invention claimed is:

1. A device intended for removably supporting a toy to a limb of a user, comprising:

a flexible sheet of fabric, said flexible sheet of fabric comprising a first surface and an opposite second surface;

said first surface further comprising a first section including a first mating material, a second section of a second mating material, and a flap rotatably attached to said flexible sheet of material, said flap further including a section of said first mating material to overlie said first surface of said flexible sheet upon rotation, said second mating material of said second section of said first surface of said flexible sheet being removably connectable to said first mating material of said flap section;

said second surface of said flexible sheet of fabric comprising a section of said second mating material, said first mating material of said first section of said first surface being removably connectable to said second mating material of said opposite second surface to encompass the limb of the user and to form a chamber, said flap being configured to hingedly rotate relative to said flexible sheet and to occupy said chamber; and the toy comprising a section of said first mating material for removably connecting the toy to said second mating material of said second section of said first surface of said flexible sheet of fabric.

2. The device of claim 1 in which said sheet of fabric further includes a pocket.

3. The device of claim 2 which further includes a patch, said patch sized to fit within said pocket.

4. The device of claim 1 in which said first mating material selectively comprises hook and pile strips.

5. The device of claim 4 in which said second mating material comprises hook and pile strips.

6. The device of claim 1 in which said fabric comprises a cloth.

7. The device of claim 6 in which said sheet of fabric further includes a pocket.

8. The device of claim 7 which further includes a patch, said patch sized to fit within said pocket.

9. The device of claim 6 in which said first mating material selectively comprises hook and pile strips.

10. The device of claim 9 in which said second mating material comprises hook and pile strips.

* * * * *